US008895828B1

(12) United States Patent
Barlow

(10) Patent No.: US 8,895,828 B1
(45) Date of Patent: Nov. 25, 2014

(54) CLIX STIXS

(76) Inventor: Von Barlow, Jacksonville, FL (US)

( * ) Notice: Subject to any disclaimer, the term of this patent is extended or adjusted under 35 U.S.C. 154(b) by 24 days.

(21) Appl. No.: 13/427,537

(22) Filed: Mar. 22, 2012

Related U.S. Application Data

(60) Provisional application No. 61/467,291, filed on Mar. 24, 2011.

(51) Int. Cl.
*G10D 13/02* (2006.01)

(52) U.S. Cl.
USPC ..... 84/422.4; 84/402

(58) Field of Classification Search
USPC ..... 84/422.4, 402
See application file for complete search history.

(56) References Cited

U.S. PATENT DOCUMENTS

| | | | | | |
|---|---|---|---|---|---|
| 976,718 | A | * | 11/1910 | Bartholomae | 446/422 |
| 2,280,582 | A | * | 4/1942 | Hoeflich | 156/253 |
| 2,466,554 | A | * | 4/1949 | Mossey | 84/422.4 |
| 2,521,336 | A | * | 9/1950 | Bramson | 84/422.4 |
| 2,616,218 | A | * | 11/1952 | Brown | 446/418 |
| 2,848,839 | A | * | 8/1958 | Haines | 446/418 |
| 3,019,553 | A | * | 2/1962 | Gomez et al. | 446/422 |
| D211,964 | S | * | 8/1968 | Valente | D17/22 |
| 3,439,572 | A | * | 4/1969 | Cohen | 84/402 |
| D220,002 | S | * | 2/1971 | Barker | D17/22 |
| 3,585,897 | A | * | 6/1971 | Stalcup | 84/422.4 |
| 3,592,097 | A | * | 7/1971 | Friede | 84/402 |
| 3,704,340 | A | * | 11/1972 | Hall | 84/170 |
| 4,269,105 | A | * | 5/1981 | Salmon | 84/402 |
| D260,655 | S | * | 9/1981 | Guay | D17/22 |
| 4,658,694 | A | * | 4/1987 | Marks et al. | 84/402 |
| 4,909,117 | A | | 3/1990 | Reiling et al. | |
| 4,970,934 | A | | 11/1990 | Reed et al. | |
| 5,044,250 | A | * | 9/1991 | Beyer | 84/422.4 |
| 5,157,213 | A | | 10/1992 | Kashio et al. | |
| 5,265,514 | A | * | 11/1993 | Schertz | 84/422.4 |
| D368,110 | S | | 3/1996 | Roos | |
| 6,002,077 | A | * | 12/1999 | Nicolosi | 84/422.4 |
| 6,316,709 | B1 | * | 11/2001 | Nanberg et al. | 84/422.4 |
| 7,470,845 | B2 | | 12/2008 | Fermie et al. | |
| D589,549 | S | * | 3/2009 | Chan | D17/22 |
| 7,960,635 | B2 | * | 6/2011 | Rice | 84/422.4 |
| 8,058,541 | B2 | * | 11/2011 | Taninbaum | 84/422.4 |
| 2006/0243118 | A1 | | 11/2006 | Malott | |
| 2012/0144975 | A1 | * | 6/2012 | Destocki | 84/402 |

OTHER PUBLICATIONS

Clix Sticks / Demonstration—YouTube, dated May 29, 2011, viewed Mar. 21, 2013 at http://www.youtube.com/watch?v=JUia6n1bRWI.*

* cited by examiner

*Primary Examiner* — David Warren
*Assistant Examiner* — Robert W Horn
(74) *Attorney, Agent, or Firm* — RG Patent Consulting LLC; Rachel Gillory

(57) ABSTRACT

Clix sticks (Clix Stixs) systems may comprise a tunable percussion instrument which may resemble a conventional drum stick on one end, and a fixed arm and flexible arm comprising a plurality of bamboo spoons on the other end. Clix sticks may further comprise a connector tube, whereby the connector tube for connecting the drum stick to the bamboo spoons. The fixed arm may comprise a pair of bamboo spoons which may be disposed in an inverted relationship creating a closed sound chamber. Within the closed sound chamber may be a clapper and a clapper support. In use, a user may grip the handle and swing the clix sticks upward and downward or against a drummable surface. The flexible arm may knock into the closed sound chamber producing an immediate clicking sound, and the clapper may knock into the interior walls of the closed sound chamber producing a delayed clicking sound.

20 Claims, 7 Drawing Sheets

CLIX STIXS

CROSS-REFERENCE TO RELATED APPLICATION

The present application is related to and claims priority from prior provisional application Ser. No. 61/467,291, filed Mar. 24, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(*d*).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of musical instruments and more specifically relates to a pair of drumsticks designed to enhance music.

2. DESCRIPTION OF THE RELATED ART

Musicians perpetually look for new ways to hone their craft. Guitarists enjoy practicing on different types of guitars and other string instruments. Pianists like to play on different types of pianos. However, the options available to a drummer's choice of drum stick are fairly limited as known in the current art. Typically, a drummer is limited to selecting a pair of wooden sticks where each strike on a drum produces a single beat. It may be more desirable for a drummer to use a drumstick that may produce multiple beats and tones.

Further, it may be difficult for drummers to practice without a set of drums. Conventional drumsticks sticks may only be used on hard surfaces, which may not always be available, especially while traveling. When playing the drums in loud outdoor settings, there is a lot of ambient noise that may drown out the sound of the drum. This requires the individual to put a great deal of effort into making the sound louder. Also, when recording, many drummers find that the click of the stick against the ride cymbal is obscured by the background wash or ringing of the cymbals. Many individuals use tape to prevent this from happening.

Various attempts have been made to solve the above-mentioned problems such as those found in U.S. Pat. No. 5,157,213 to Kashio et al; U.S. Pat. No. 4,909,117 to Reiling et al; U.S. Pat. No. 7,470,845 to Fermie et al; 2006/0243118 to Malott; U.S. Pat. No. 4,970,934 to Reed et al; D368,110 to Roos; and U.S. Pat. No. 5,265,514 to Schertz. This prior art is representative of multi-sound producing drumsticks. None of the above inventions and patents, taken either singly or in combination, is seen to describe the invention as claimed.

Ideally, clix sticks systems should provide a musician with a fun and unique set of drumsticks for producing a variety of beats and tones and, yet, would operate reliably and be manufactured at a modest expense. Thus, a need exists for clix sticks systems which may provide a drummer with a set of drumsticks, each drumstick comprising a typical drum tip on one end of the stick, and a dual-beat sound chamber assembly on the other end. The dual-beat sound chamber assembly may produce an immediate first clicking sound and a second delayed clicking sound with a single flick of the wrist thereby providing a drummer with a novel set of drumsticks and to avoid the above-mentioned problems.

BRIEF SUMMARY OF THE INVENTION

In view of the foregoing disadvantages inherent in the known drum stick art, the present invention provides a novel tunable percussion instrument system. The general purpose of the present invention, which will be described subsequently in greater detail, is to provide a tunable percussion instrument for providing a user, such as a drummer, with a novel drumming stick for producing a plurality of tones and beats.

The tunable percussion instrument of the present invention may comprise a conventional drum stick on one end and a set of bamboo spoons on the other end. The drum stick end may comprise a tip, a shoulder, a shaft, and a butt. The tip may be used to strike a drummable surface. The shoulder comprises a sloped region feeding into the shaft which feeds into the end of the drum stick comprising the butt. The clix stick may further comprise a connector tube. The connector tube may comprise a cylindrical part comprising a ferrous material such as copper which connects the drum stick to the set of bamboo spoons. One end of the connector tube may be used to receive the butt of the drum stick.

The tunable percussion instrument further comprises a fixed arm and a flexible arm. A proximal end of both the fixed arm and the flexible are fittably mounted into an end of the connector tube opposing the end that receives the drum stick. The fixed arm may comprise a pair of bamboo spoons whereby the spoon heads are inversely disposed creating hollow space acting in a capacity of a closed sound chamber. Internally installed within the closed sound box may be a clicker assembly comprising a clapper and a clapper support. The clapper may comprise a dense ferrous material, such as lead. The clapper support may comprise a pliable ferrous material similar to a saw blade. The clapper may be fixedly mounted to a distal end of the clapper support. The flexible arm may comprise a single bamboo spoon. The flexible arm may act in the capacity of an open sound chamber. A head of the single bamboo spoon may comprise a counterweight. The counterweight may comprise a stone, such as a gem stone.

The tunable percussion instrument may further comprise a handle. In one embodiment, the handle may comprise bamboo. In other embodiments, the handle may comprise plastic, such as PVC. The handle preferably comprises an ergonomic gripping surface providing a comfortable grip for the user. The handle may be fixedly disposed over the connector tube.

In use, a flicking motion by a wrist of the user may produce an immediate click when a weighted force of the counterweight causes the open sound chamber to collide into the closed sound chamber. Upon the collision of the open sound chamber into the closed sound chamber, the clapper that is movably retained by the clapper support knocks into an interior wall of the closed sound chamber thereby producing a delayed clicking sound. Therefore, when the user strikes a drummable surface with the tip of the drum stick, 3 tones may be produced.

Clix sticks may comprise a drum stick comprising wood. The drum stick may comprise a tip, a shoulder, a shaft, and a butt. The clix sticks may further comprise a hollow cylindrically shaped connector tube, the connector tube may comprise ferrous material, the connector tube may comprise an open proximal end and an open distal end, and the connector tube may act in a capacity of a sound box. The clix sticks may further comprise a handle, which may comprise an ergonomic gripping surface.

Furthermore, the clix sticks may comprise a fixed arm comprising bamboo, and a flexible arm comprising bamboo, the flexible arm further comprising a counterweight. A terminal end of the fixed arm receives a top bamboo spoon and a bottom bamboo spoon. The top bamboo spoon and the bottom bamboo spoon may be fixedly disposed in an inverted relationship creating a closed sound chamber, whereby a hollow space within the closed sound chamber comprises a clicker assembly. The clicker assembly may comprise a clapper and a clapper support. The clapper may comprise a dense ferrous material, the clapper support may comprise a pliable material. The clapper may be non-movably mounted to the clapper support and the clapper support may be movably retained between the top spoon and the bottom spoon of the fixed arm such that the clapper may come into contact with at least one interior wall within the closed sound chamber upon a shaking motion of the tunable percussion instrument system by the user.

The flexible arm may comprise a clicking spoon, the clicking spoon comprising bamboo, and the clicking spoon may comprise a spoon-counterweight. The spoon-counterweight may comprise a stone. The clicking spoon acts as an open sound chamber. The handle may comprise a grippable cylinder that may be fixedly mounted over the connector tube.

The butt of the drum stick may be fixedly inserted into the distal end of the connector tube. An opposing end of the terminal end of the fixed arm may be fixedly inserted into the proximal end of the connector tube, and an opposing end of the terminal end of the flexible arm may be flexibly inserted into the proximal end of the connector tube. A right hand or a left hand of the drummer may grip the handle and manipulate the tunable percussion instrument system such that different tones are able to be produced as the closed sound chamber and the open sound chamber are collided one with the other.

The present invention holds significant improvements and serves as a clix sticks system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, clix sticks systems, constructed and operative according to the teachings of the present invention

The various embodiments of the present invention will hereinafter be described in conjunction with the appended drawings, wherein like designations denote like elements.

DETAILED DESCRIPTION

As discussed above, embodiments of the present invention relate to a clix sticks system and more particularly to a tunable percussion instrument comprising a musical device designed to enhance musical sounds and to promote musical creativity.

Figure 1:
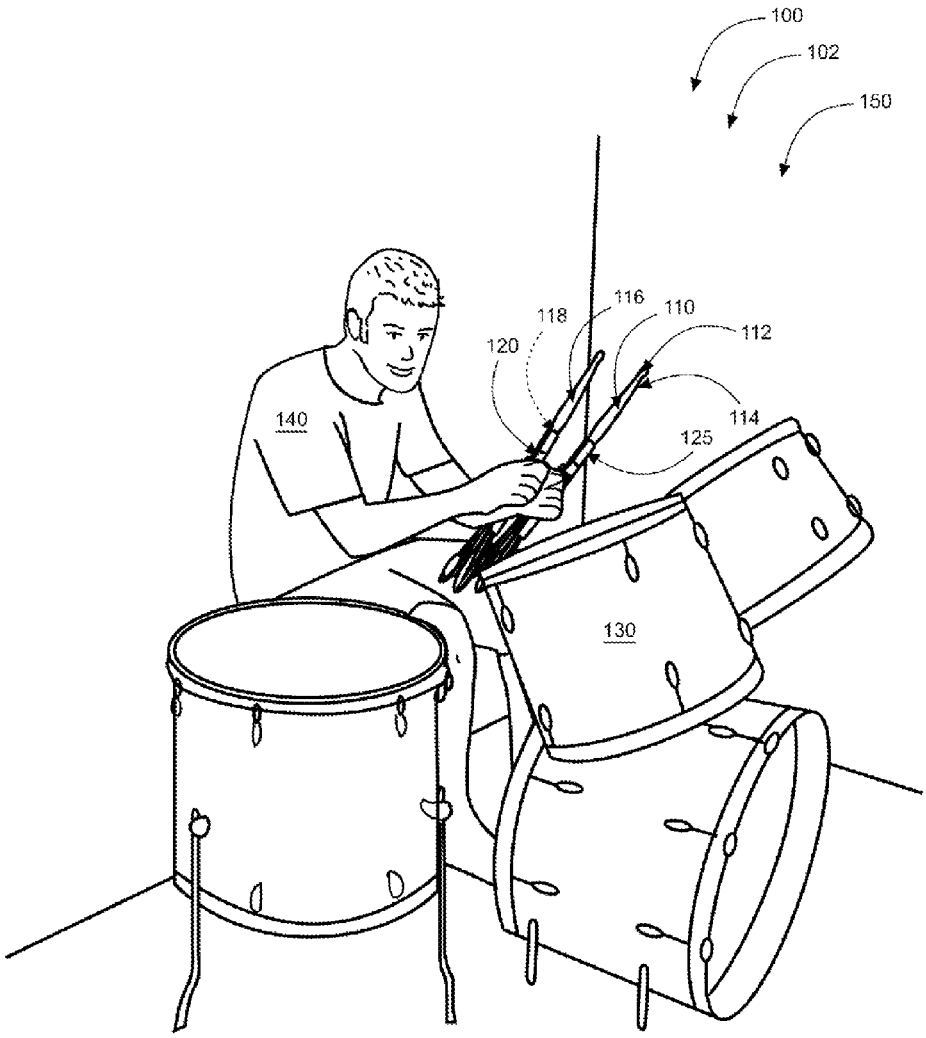
FIG. 1 is a perspective view illustrating a clix sticks system, during an 'in use' condition showing a user banging a drum stick tip of a drum stick of a tunable percussion instrument to bang a set of drums according to an embodiment of the present invention.

Referring to the drawings by numerals of reference there is shown in FIG. 1, tunable percussion instrument system 100 during 'in-use' condition 150 according to an embodiment of the present invention. Tunable percussion instrument system 100 may comprise clix sticks 102, a musical instrument providing user 140 with a versatile, beat producing drum stick 110. As shown, clix sticks 102 may generally comprise two sound producing ends. One end may comprise drum stick 110. The other end may comprise a plurality of bamboo spoons for producing a "click" beat sound. Both ends may be secured together via connector tube 125. Drum stick 110 may comprise tip 112, shoulder 114, shaft 116, and butt 118. Tip 112 may comprise an end of drum stick 110 which may be used to strike a drummable surface, such as drums 130, as shown in FIG. 1. Shoulder 114 may comprise a sloped region of drum stick 110 leading from tip 112 to shaft 116. Shaft 116 may extend toward butt 118. In one embodiment of tunable percussion instrument system 100, drum stick 110 may comprise wood. It should be noted however that in alternative embodiments, drum stick 110 may comprise plastic.

In continuing to refer to FIG. 1, clix sticks 102 may comprise connector tube 125 for connecting drum stick 110 to a plurality of bamboo spoons for producing supplemental click sounds. Connector tube 125 may comprise a hollow, cylindrical tube having two open ends. In a preferred embodiment, connector tube 125 comprises a ferrous material, such as copper. As shown in FIG. 1, a distal end of connector tube 125 may receive butt 118 of drum stick 110. Connector tube 125 may further receive the plurality of spoons in a proximal end. Further, tunable percussion instrument system 100 may comprise handle 120. Handle 120 may fit over connector tube 125 and may provide a comfortable and ergonomic gripping surface for user 140 to hold and manipulate clix sticks 102. In one embodiment of tunable percussion instrument system 100, handle 120 may comprise bamboo. However in alternative embodiments, handle 120 may comprise PVC plastic, metal, wood, or other suitable materials.

In still referring to FIG. 1, tunable percussion instrument system 100 may comprise a pair of clix sticks 102 such that user 140 may use tunable percussion instrument system 100 by holding two clix sticks 102, one in each hand, similar to a pair of drum sticks 110 to produce concurrent beats and sounds.

Figure 2:
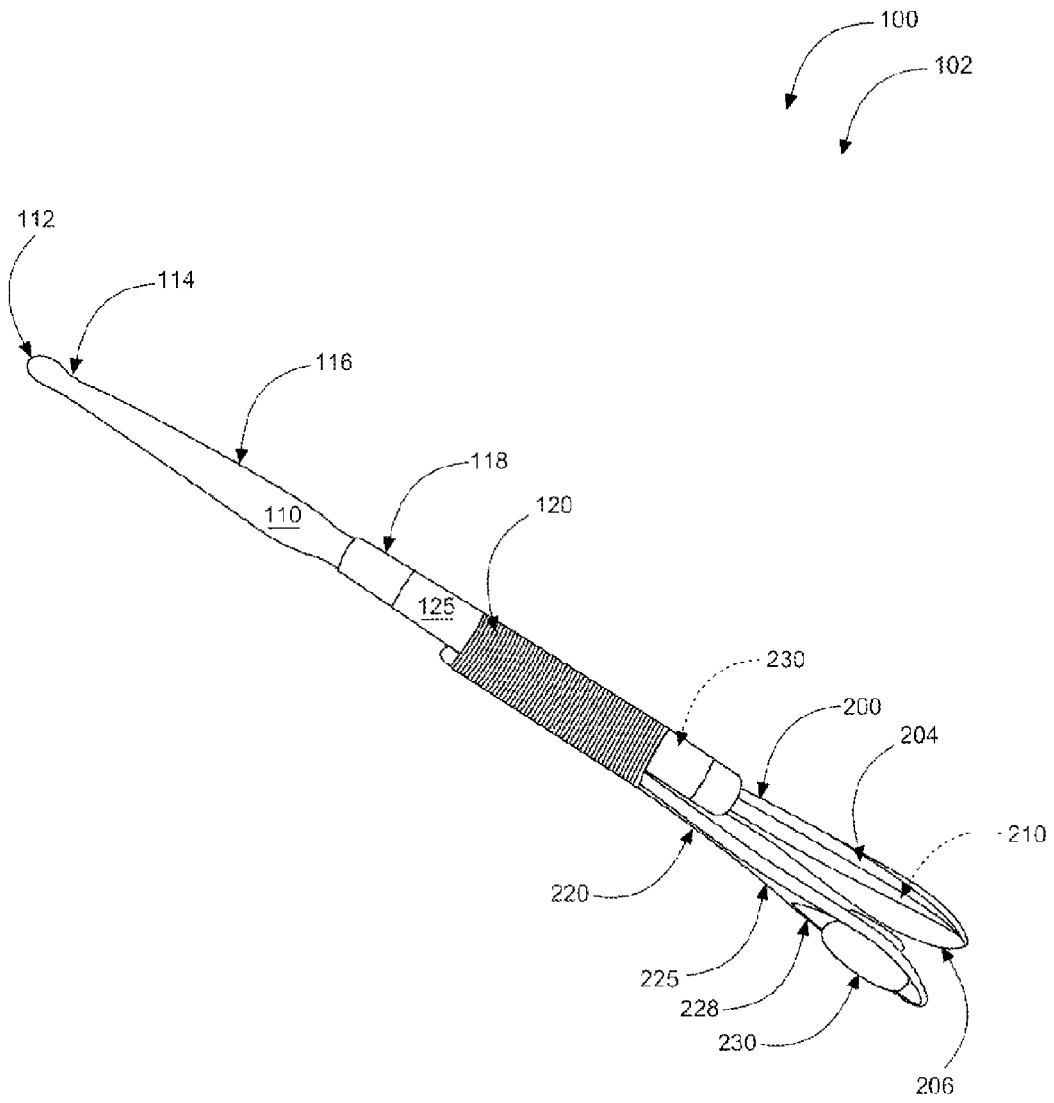
FIG. 2 is a perspective view illustrating the tunable percussion instrument comprising a drum stick end and an end comprising a plurality of bamboo spoons for producing at least one clicking sound according to an embodiment of the present invention of FIG. 1.

Referring now to FIG. 2 illustrating a perspective view of tunable percussion instrument system 100 comprising clix sticks 102 according to an embodiment of the present invention of FIG. 1. As shown, clix sticks 102 may generally comprise two sound producing ends. One end comprises drum stick 110 and the other end comprises fixed arm 200 and flexible arm 220 for producing at least two different types of clicking sounds. Fixed arm 200 may comprise top bamboo spoon 204 and bottom bamboo spoon 206. As shown, a spoon head portion of both top bamboo spoon 204 and bottom bamboo spoon 206 may be fixedly disposed in an inverted relationship thereby creating closed sound chamber 210. Closed sound chamber 210 may comprise a hollow confine that exists between top bamboo spoon 204 and bottom bamboo spoon 206. A terminal end of fixed arm 200 may be non-movably retained by the proximal end of connector tube 125 such that fixed arm 200 remains stationary during use of clix sticks 102.

Preferably, fixed arm 200 comprises bamboo. Alternatively, fixed arm 200 may comprise wood, plastic, or other suitable material. It should be appreciated that by altering the composition of fixed arm 200, a sound produced by closed sound chamber 210 may be altered according to a preference of user 140.

In continuing to refer to FIG. 2, flexible arm 220 may comprise clicking spoon 225. Clicking spoon 225 may comprise a single spoon made from bamboo. Alternatively clicking spoon 225 may comprise wood or other composition. Flexible arm 220 may further comprise counterweight 230 which may be glued to a spoon head surface of clicking spoon 225. In one embodiment of the present invention, counterweight 230 a stone such as a gemstone. In other embodiments, counterweight 230 may comprise glass, lead, or other dense material. The spoon head of clicking spoon 225 may comprise open sound chamber 228. As shown in FIG. 2, a terminal end of flexible arm 220 may be movably mounted between connector tube 125 and handle 120. In such a manner, flexible arm 220 is able to move backwards and forwards in relation to fixed arm 200 upon a flicking motion of clix sticks 102.

In still referring to FIG. 2, it should be noted that connector tube 125 may act in a capacity of sound box 235 when open sound chamber 228 of flexible arm 220 collides into closed sound chamber 210 of fixed arm 200. When user 140 manipulates clix sticks 102 via handle 120 in an up-and-down flicking motion, a top part of clicking spoon 225 may knock into bottom bamboo spoon 206 of fixed arm 200 causing strong vibrations, also known as resonances, to travel transversely from an opposing end of flexible arm 220 and fixed arm 200 into connector tube 125 acting as sound box 235. In such a manner, sound box 235 may produce resonances at lower frequencies, enhancing a lower-frequency response of clix sticks 102 thereby producing a clicking-type sound.

Figures 3A, 3B:
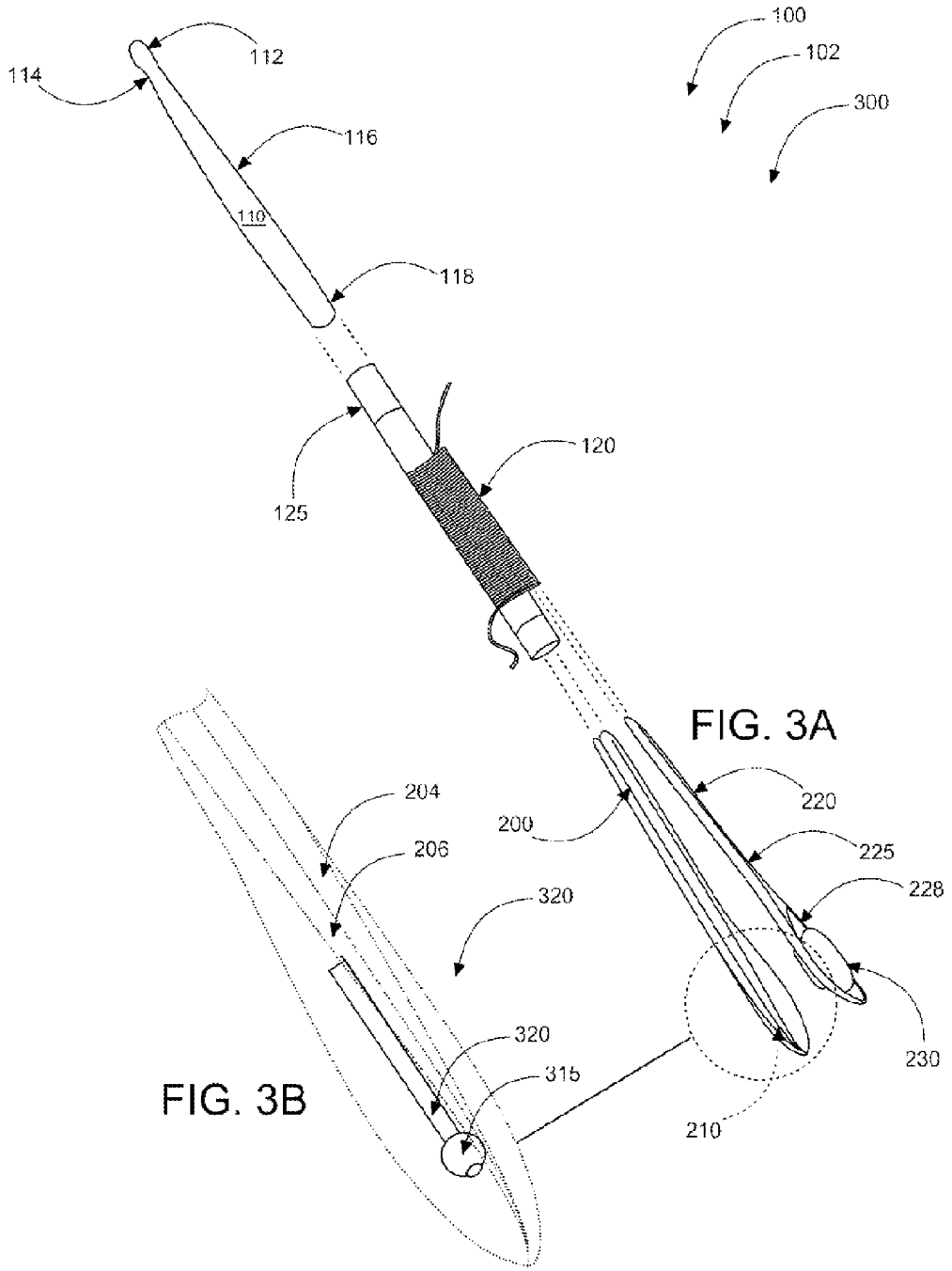
FIG. 3A is an exploded view illustrating the tunable percussion instrument according to an embodiment of the present invention of FIG. 1.
FIG. 3B is an exploded view illustrating a clicker assembly of the tunable percussion instrument according to an embodiment of the present invention of FIG. 1.

In turning now to FIGS. 3A and 3B, showing exploded view 300 of tunable percussion instrument system 100 according to an embodiment of the present invention of FIG. 1. As shown in FIG. 3A, butt 118 of drum stick 110 may be inserted into the distal end of connector tube 125. Handle 120 may be fittable over a center region of connector tube 125. The terminal end of fixed arm 200 may be non-movably mounted into the proximal end of connector tube 125. Top bamboo spoon 204 may be secured together to bottom bamboo spoon 206 such that a head of top bamboo spoon 204 and a head of bottom bamboo spoon 206 are fixedly disposed in an inverted relationship thereby forming closed sound chamber 210.

The terminal end of flexible arm 220 may be mounted between an outside area of connector tube 125 and an inside area of handle 120. In an alternative method of construction of the present invention, flexible arm 220 may be inserted into the proximal end of connector tube 125 along with fixed arm 200. Flexible arm 220 may comprise clicker spoon 225. Clicker spoon 225 may comprise a bamboo spoon. Counterweight 230 may be attached to the spoon portion of clicker spoon 225. Preferably, counterweight 230 is attached to the spoon portion of clicker spoon 225 via glue. Alternatively, counterweight 230 may be fastened to clicker spoon 225 via an adhesive, tape, a band, or the like.

Turning now to FIG. 3B, illustrating a close-up interior perspective view of closed sound chamber 210 of tunable percussion instrument system 100. Closed sound chamber 210 may comprise a hollow confine space that exists between top bamboo spoon 204 and bottom bamboo spoon 206. Closed sound chamber 210 may comprise clicker assembly 310. Clicker assembly 310 may comprise clapper 315 and clapper support 320. Clapper 315 may comprise a dense ferrous material. In a preferred embodiment of clix sticks 102, clapper 315 comprises lead. Alternatively, clapper 315 may comprise metal, rocks, glass, or the like. Clapper support 320 may comprise a thin metallic support for supporting clapper 315. In an embodiment of clix sticks 102, clapper support 320 may comprise a thin metal blade that is pliable. Alternatively, clapper support 320 may comprise plastic.

Clapper 315 may be fixedly attached to a bottom end of clapper support 320 via a fastener. In such a manner, clapper 315 may dangle freely within closed sound chamber 210 of fixed arm 200. When open sound chamber 228 of flexible arm 220 collides into closed sound chamber 210 of fixed arm 200, clapper 315 may knock into an interior side wall of closed sound chamber 210 thereby producing a second clicking sound. This second clicking sound may be occur after the first clicking sound caused by the collision between open sound chamber 228 and closed sound chamber 210 resulting in the second clicking sound being a delayed clicking sound.

Figure 4A:
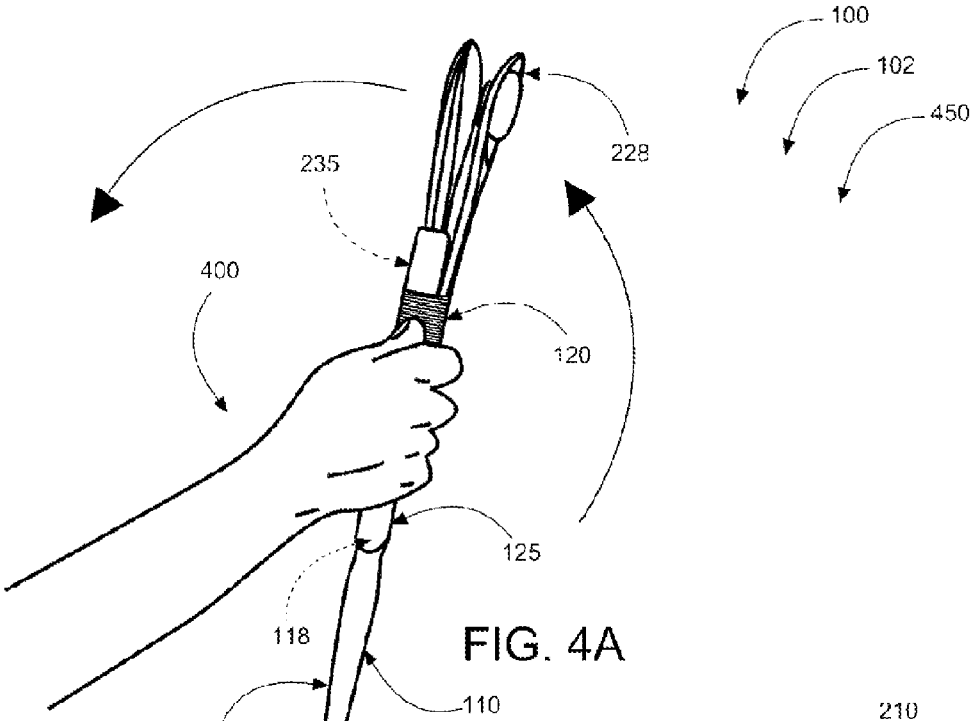
FIGS. 4A and 4B show a perspective view of clix sticks system during an 'in-use' condition illustrating the user holding a handle of the tunable percussion instrument and flicking a wrist of the user upward and downward to produce clicking sounds according to an embodiment of the present invention of FIG. 1.
Figure 4B:
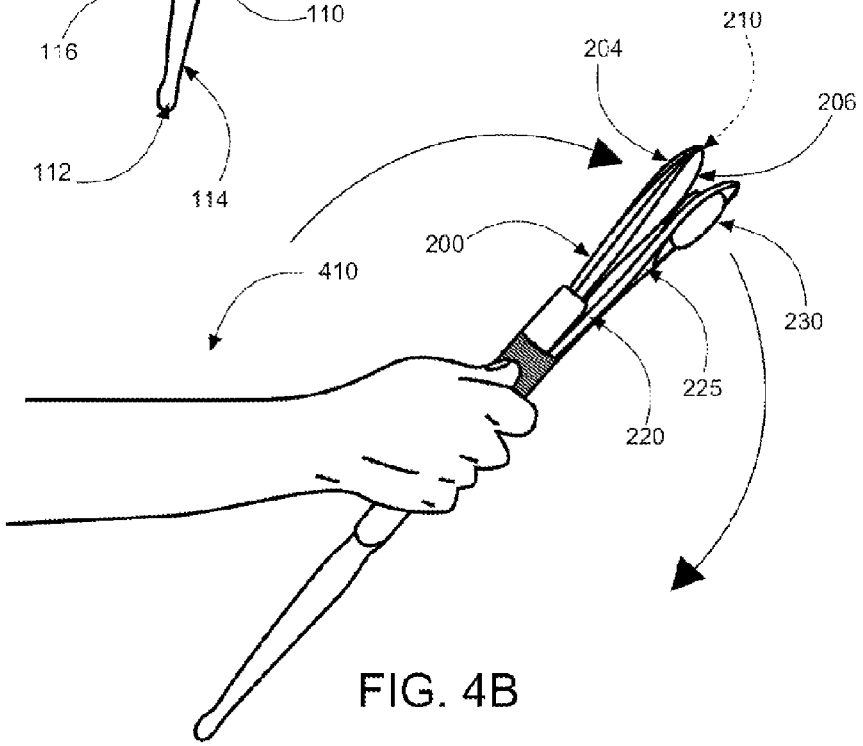

Referring now to FIGS. 4A and 4B, showing tunable percussion instrument system 100 during 'in-use' condition 450 according to an embodiment of the present invention. As shown in FIG. 4A, user 140 may hold clix sticks 102 via handle 120 and may swing clix sticks 102 in an upward fashion as referenced by first swinging motion 400. In such a manner, flexible arm 220 comprising clicking spoon 225 comprising counterweight 230 may knock into bottom bamboo spoon 206 of fixed arm 200 producing a first clicking sound. This first clicking sound produced by first swinging motion 400 may be modified by the strength of the swing by user 140, which in turn may produce stronger or weaker resonance waves traveling downward into connector tube 125 which may act as sound box 235, as shown.

In referring now to FIG. 4B, user 140 may swing clix sticks 102 in a downward fashion as referenced by second swinging motion 410. Second swinging motion 410 may cause clapper 315 housed between top bamboo spoon 204 and bottom bamboo spoon 206 of fixed arm 200 to knock into at least one interior wall of closed sound chamber 210 thereby producing a second clicking sound. The strength of the second clicking sound may vary depending on the strength of second swinging motion 410.

It may further be noted that first swinging motion 400 or second swinging motion 410 may be used against a drummable surface for producing a plurality of beats and tones. For example, user 140 may strike clicking spoon 225 or top bamboo spoon 204 against a drummable surface. A beat may be produced when clix sticks 102 strikes the drummable surface, followed by an immediate click when clicking spoon 225 strikes bottom bamboo spoon 206, and then followed by a delayed click when clapper 315 knocks into one of the interior walls of closed sound chamber 210. It should be appreciated that the drummable surface may comprise drums 130, a wall, a floor, a part of a body, or other planar surface.

Figure 5:
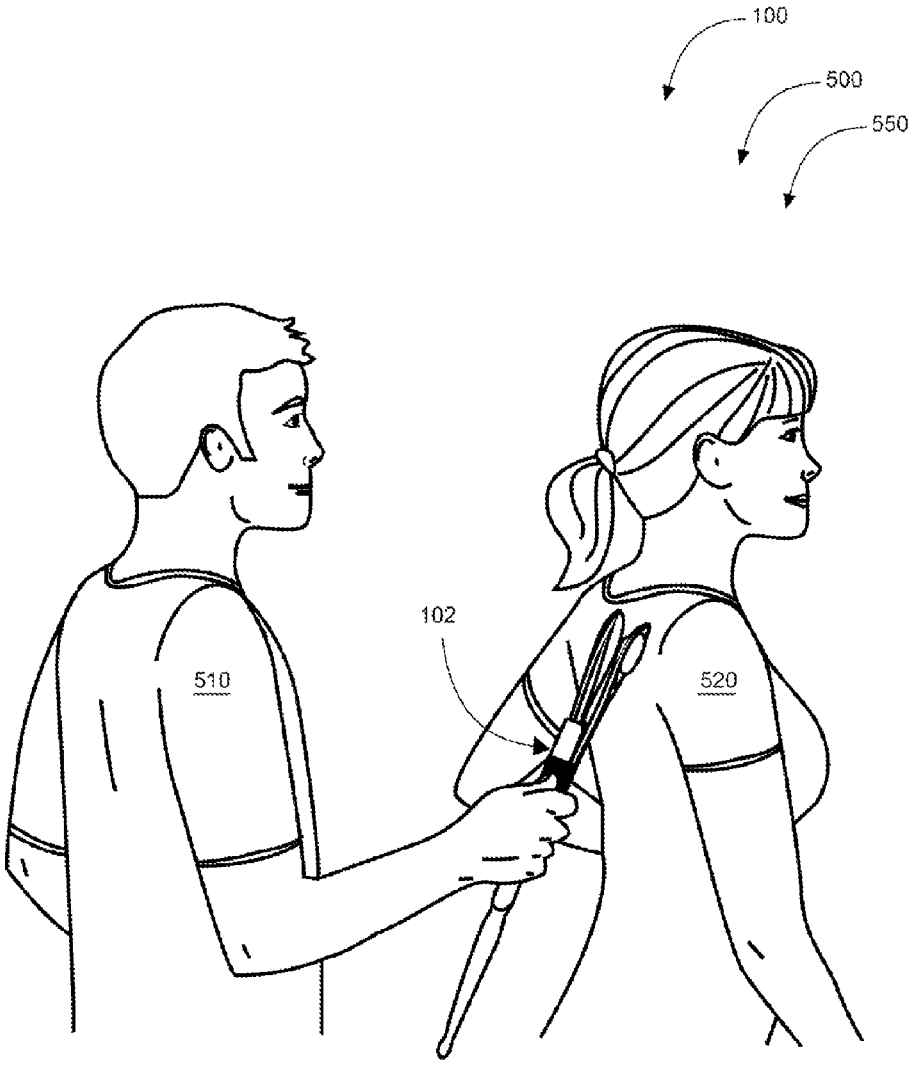
FIG. 5 shows a perspective view of the clix sticks system during an 'in-use' condition showing the user massaging another person's back with the tunable percussion instrument in the capacity of a massage tool according to an embodiment of the present invention.

Referring now to FIG. 5, illustrating an alternative use of tunable percussion instrument system 100 during 'in-use' condition 550 according to an embodiment of the present invention. As shown, user 140 comprising masseuse 510 may use clix sticks 102 on a body part of another person, where the other person comprises massage recipient 520. In such a manner, tunable percussion instrument system 100 may be used in a capacity of massage tool 500. As shown in FIG. 5, masseuse 510 may hold clix sticks 102 via handle 120 and bang fixed arm 200 comprising top bamboo spoon 204 and bottom bamboo spoon 206, and flexible arm 220 comprising clicking spoon 225, on a body region of massage recipient 520, such as a back area of massage recipient 520, which may provide massage relief. It should be appreciated that clix sticks 102 used as massage tool 500 may be used on a neck region, shoulder region, arm region, buttocks region, leg region, or feet region of massage recipient 520.

Figure 6:
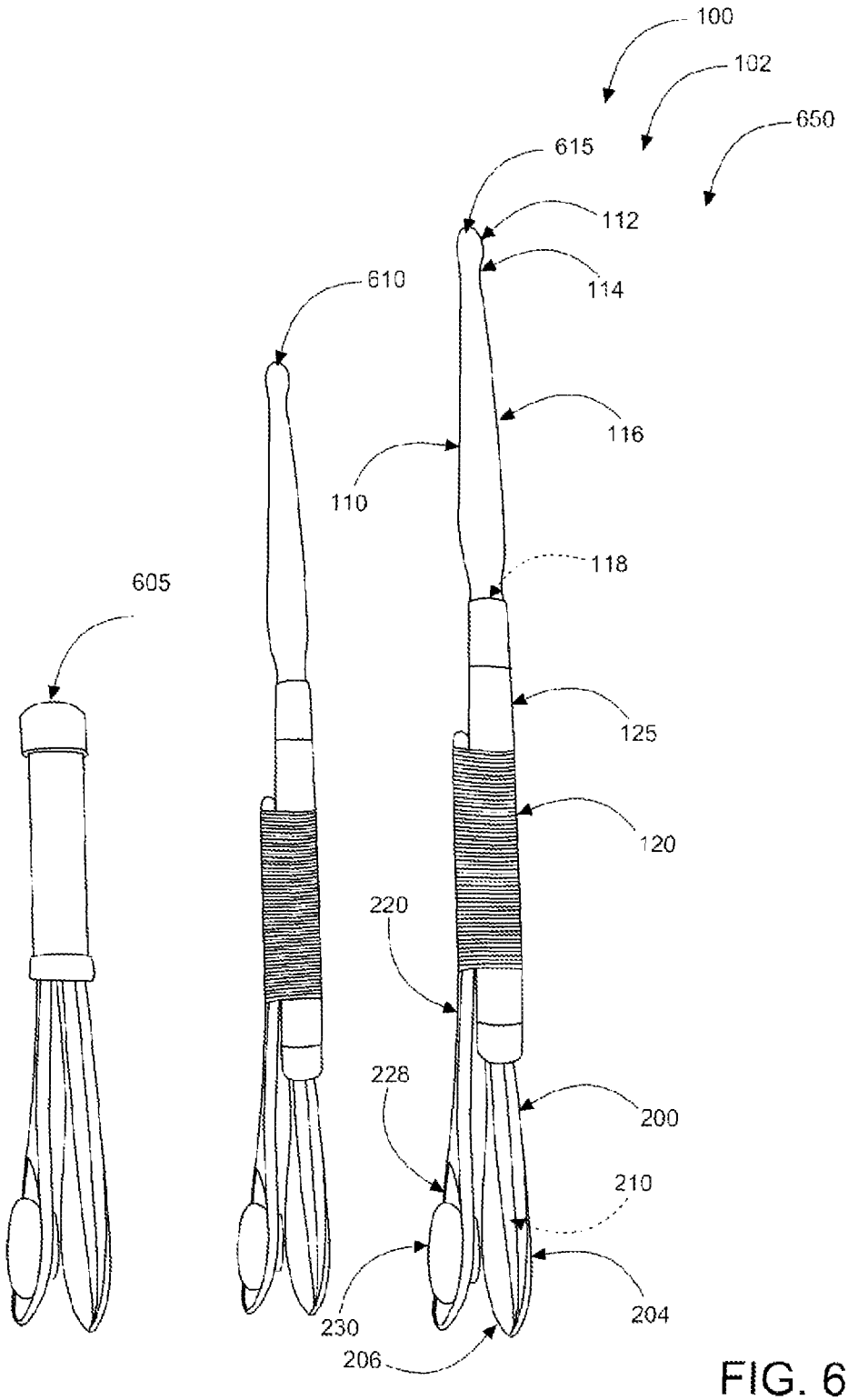
FIG. 6 shows a perspective view illustrating the clix sticks systems comprising a set of tunable percussion instruments of varying sizes to be sold as a kit according to an embodiment of the present invention.

Referring now to FIG. 6, illustrating tunable percussion instrument system 100 comprising kit 650. Kit 650 may comprise clix sticks 102 of varying lengths, widths, and styles for use by user 140. As shown, kit 650 may comprise short clix sticks 605, medium clix sticks 610, and long clix sticks 615. Short clix sticks 605 may comprise handle 120, connector tube 125, fixed arm 200 comprising closed sound chamber 210 and flexible arm 220 comprising open sound chamber 228. Medium clix sticks 610 and long clix sticks 615 may each comprise drum stick 110 in addition to handle 120, connector tube 125, fixed arm 200 comprising closed sound chamber 210 and flexible arm 220 comprising open sound chamber 228.

It should be noted and appreciated that clix sticks 102 may comprise different colors, materials, designs, logos, pictures, and other indicia adorned to a surface of drum stick 110, handle 120, fixed arm 200, and flexible arm 220.

Tunable percussion instrument system 100 comprising clix sticks 102 for use by user 140 comprising a drummer comprising drum stick 110 comprising wood. Drum stick 110 may comprise tip 112, shoulder 114, shaft 116, and butt 118. Clix sticks 102 may additionally comprise hollow, cylindrically shaped connector tube 125, connector tube 125 comprising copper, connector tube 125 comprising an open proximal end and an open distal end, and connector tube 125 acting in a capacity of sound box 235. Clix sticks 102 may further comprise handle 120, handle 120 comprising bamboo, and handle 120 comprising an ergonomic gripping surface for user 140 to manipulate clix sticks 102. Clix sticks 102 may additionally comprise fixed arm 200 comprising bamboo, and flexible arm 220 comprising bamboo, flexible arm 220 further may comprise counterweight 230, counterweight 230 comprising lead.

A terminal end of fixed arm 200 receives top bamboo spoon 204 and bottom bamboo spoon 206. Top bamboo spoon 204 and bottom bamboo spoon 206 may be fixedly disposed in an inverted relationship creating closed sound chamber 210. A hollow space within closed sound chamber 210 comprises clicker assembly 310. Clicker assembly 310 may comprise clapper 315 and clapper support 320. Further, clapper 315 may a dense ferrous material, such as lead. Clapper support 320 may comprise a pliable material comparable to a saw blade. Clapper 315 may be non-movably mounted to an end of clapper support 320 and clapper support 320 is movably retained between top bamboo spoon 204 and bottom bamboo spoon 206 of fixed arm 200 such that clapper 315 may come into contact with at least one interior wall within closed sound chamber 210 upon a shaking motion of tunable percussion instrument system 100.

Flexible arm 220 may comprise clicking spoon 225, clicking spoon 225 comprising bamboo. Clicking spoon 225 may comprise counterweight 230. In one embodiment of the present invention, counterweight 230 comprises a stone. Clicking spoon 225 may act as open sound chamber 228.

Handle 120 of clix sticks 102 may comprise a grippable cylindrical member that may be fixedly mounted over connector tube 125. Butt 118 of drum stick 110 may be fixedly inserted into the distal end of connector tube 125. An opposing end of the terminal end of fixed arm 200 is fixedly inserted into the proximal end of connector tube 125. An opposing end of the terminal end of flexible arm 220 may be flexibly inserted into the proximal end of connector tube 125. A hand of user 140 may grip handle 120 and manipulate tunable percussion instrument system 100 such that different tones are able to be produced as closed sound chamber 210 and open sound chamber 218 are collided one with the other.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 7:
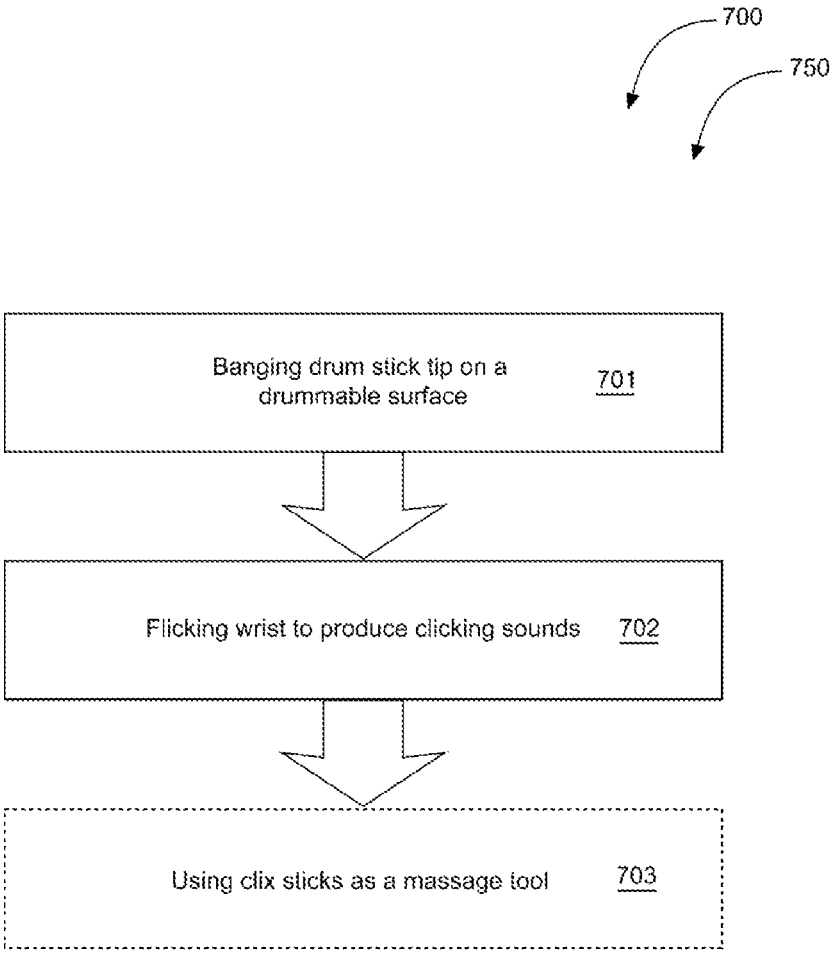
FIG. 7 is a flowchart illustrating a method of use according to an embodiment of the present invention of FIGS. 1-6.

Referring now to FIG. 7, illustrating flowchart 750 comprising method of use 700 of tunable percussion instrument system 100 according to an embodiment of the present invention of FIGS. 1-4. Method of use 700 may comprise the steps of: step one 701 banging tip 112 of drum stick 110 on a drummable surface; and step two 702 flicking wrist of user 140 to produce clicking sounds.

Method of use 700 of tunable percussion instrument system 100 may comprise an optional step three 703 of using clix sticks 102 by user 140 comprising masseuse 510 on a body part of another person comprising massage recipient 520 in a capacity of massage tool 500. In such a method, masseuse 510 may hold clix sticks 102 via handle 120 and bang fixed arm 200 and flexible arm 220 comprising bamboo spoons on a body region of massage recipient 520 which may provide relief to the other person.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tunable percussion instrument system comprising:
- a clix stick assembly comprising;
  - a drum stick, said drum stick comprising;
    - a tip;
    - a shoulder;
    - a shaft; and
    - a butt;
  - a hollow cylindrically shaped connector tube comprising an open proximal end and an open distal end;
  - a handle;
  - a fixed arm comprising a counterweight; and
  - a flexible arm;
- wherein a terminal end of said fixed arm receives a top bamboo spoon and a bottom bamboo spoon;
- wherein said top bamboo spoon and said bottom bamboo spoon are fixedly disposed in an inverted relationship creating a closed sound chamber;
- wherein a hollow space within said closed sound chamber comprises a clicker assembly, said clicker assembly comprising a clapper and a clapper support;
- wherein said clapper is non-movably mounted to said clapper support;
- wherein said clapper support is movably retained between said top spoon and said bottom spoon of said fixed arm such that said clapper contacts at least one interior wall within said closed sound chamber upon a shaking motion of said tunable percussion instrument system;
- wherein said flexible arm comprises a clicking spoon;
- wherein said clicking spoon comprises a spoon-counterweight;
- wherein said clicking spoon acts as an open sound chamber;
- wherein said handle comprises a grippable cylinder that is fixedly mounted over said connector tube;
- wherein said butt of said drum stick is fixedly inserted into said distal end of said connector tube;
- wherein an opposing end of said terminal end of said fixed arm is fixedly inserted into said proximal end of said connector tube;
- wherein an opposing end of said terminal end of said flexible arm is flexibly inserted into said proximal end of said connector tube; and
- wherein a first hand of a user grips said handle and manipulates said tunable percussion instrument system such that different tones are able to be produced as said closed sound chamber and said open sound chamber are collided one with the other.

2. The tunable percussion instrument system of claim 1 wherein a flicking motion of said drum stick by said hand of said user causes said open sound chamber of said flexible arm to collide into said closed chamber of said fixed arm producing a first immediate clicking sound.

3. The tunable percussion instrument system of claim 2 wherein said flicking motion causing said open chamber to collide into said closed chamber then causes said clapper support to swing said clapper into an interior wall of said closed sound chamber producing a second delayed clicking sound.

4. The tunable percussion instrument system of claim 1 further comprising at least one additional said clix stick assembly for use by a second hand of said user.

5. The tunable percussion instrument system of claim 1 wherein said connector tube comprises and acts in a capacity of a sound box.

6. The tunable percussion instrument system of claim 3 wherein said connector tube comprises a ferrous material.

7. The tunable percussion instrument system of claim 1 wherein said drum stick comprises wood.

8. The tunable percussion instrument system of claim 1 wherein said fixed arm and said flexible arm comprises bamboo.

9. The tunable percussion instrument system of claim 1 wherein a downward flicking motion by said hand of said user striking a drummable surface with said tip of said drum stick produces a drum beat sound.

10. The tunable percussion instrument system of claim 9 wherein said drummable surface comprises a drum.

11. The tunable percussion instrument system of claim 9 wherein said drummable surface comprises a planar surface.

12. The tunable percussion instrument system of claim 9 wherein said drummable surface comprises a body part of said user.

13. The tunable percussion instrument system of claim 12 wherein said tunable percussion instrument system is able to act in a capacity of a massage tool.

14. The tunable percussion instrument system of claim 1 wherein said clapper comprises a dense ferrous material.

15. The tunable percussion instrument system of claim 1 wherein said clapper support comprises a pliable ferrous material.

16. The tunable percussion instrument system of claim 1 wherein said handle comprises an ergonomic gripping surface.

17. A clix stick for use by a drummer comprising:
- a drum stick comprising wood, said drum stick comprising;
  - a tip;
  - a shoulder;
  - a shaft; and
  - a butt;
- a hollow cylindrically shaped connector tube, said connector tube comprising a ferrous material, said connector tube comprising an open proximal end and an open distal end, and said connector tube acting in a capacity of a sound box;
- a handle, said handle comprising an ergonomic gripping surface;
- a fixed arm comprising bamboo; and
- a flexible arm comprising bamboo, said flexible arm further comprising a counterweight, said counterweight comprising lead;

wherein a terminal end of said fixed arm receives a top bamboo spoon and a bottom bamboo spoon;

wherein said top bamboo spoon and said bottom bamboo spoon are fixedly disposed in an inverted relationship creating a closed sound chamber;

wherein a hollow space within said closed sound chamber comprises a clicker assembly, said clicker assembly comprising a clapper and a clapper support, said clapper comprising a dense ferrous material, said clapper support comprising a pliable material;

wherein said clapper is non-movably mounted to said clapper support;

wherein said clapper support is movably retained between said top spoon and said bottom spoon of said fixed arm such that said clapper contacts at least one interior wall within said closed sound chamber upon a shaking motion of said tunable percussion instrument system;

wherein said flexible arm comprises a clicking spoon, said clicking spoon comprising bamboo;

wherein said clicking spoon comprises a spoon-counterweight, said spoon-counterweight comprising a stone;

wherein said clicking spoon acts as an open sound chamber;

wherein said handle comprises a grippable cylinder that is fixedly mounted over said connector tube;

wherein said butt of said drum stick is fixedly inserted into said distal end of said connector tube;

wherein an opposing end of said terminal end of said fixed arm is fixedly inserted into said proximal end of said connector tube;

wherein an opposing end of said terminal end of said flexible arm is flexibly inserted into said proximal end of said connector tube; and wherein a first hand of said drummer grips said handle and manipulates said tunable percussion instrument system such that different tones are able to be produced as said closed sound chamber and said open sound chamber are collided one with the other.

18. The percussion instrument system for use by said drummer of claim 17 comprising a kit, wherein said kit comprises more than one said clix stick wherein said more than one said clix stick comprises various lengths, colors, designs, and indicia.

19. A method of using a tunable percussion instrument system by a user comprising the steps of:

banging a tip of a drum stick of a clix stick on a drummable surface; and flicking a wrist of said user holding said clix stick to produce at least one clicking sound.

20. The method of using said tunable percussion instrument system of claim 19 further comprises the optional step of using said clix stick in the capacity of a massage tool.

* * * * *